US005620497A

United States Patent [19]

Aschenbeck et al.

[11] Patent Number: 5,620,497

[45] Date of Patent: Apr. 15, 1997

[54] WOOL PACK FORMING APPARATUS USING HIGH SPEED ROTATING DRUMS AND LOW FREQUENCY SOUND DISTRIBUTION

[75] Inventors: David P. Aschenbeck; Michael T. Pellegrin, both of Newark, Ohio

[73] Assignee: Owens Corning Fiberglas Technology Inc., Summit, Ill.

[21] Appl. No.: 465,209

[22] Filed: Jun. 5, 1995

Related U.S. Application Data

[62] Division of Ser. No. 236,067, May 2, 1994.

[51] Int. Cl.[6] ..... C03B 37/04

[52] U.S. Cl. ..... 65/505; 65/518; 65/516

[58] Field of Search ..... 65/505, 518, 516

[56] References Cited

U.S. PATENT DOCUMENTS

| | | |
|---|---|---|
| 2,736,362 | 2/1956 | Slayter et al. . |
| 2,897,874 | 8/1959 | Stalego et al. . |
| 2,931,076 | 4/1960 | Clark . |
| 2,940,134 | 6/1960 | Heritage . |
| 2,990,004 | 6/1961 | Sowers et al. . |
| 3,250,602 | 5/1966 | Stalego . |
| 3,477,103 | 11/1969 | McCardell Troth, Jr. . |
| 3,720,361 | 3/1973 | Nommensen . |
| 3,824,086 | 7/1974 | Perry et al. . |
| 3,865,540 | 2/1975 | Loeffler . |
| 3,900,302 | 8/1975 | Langlois et al. . |
| 3,981,708 | 9/1976 | Loeffler et al. . |
| 4,167,404 | 9/1979 | Loeffler et al. . |
| 4,478,624 | 10/1984 | Battigelli et al. . |
| 4,486,211 | 12/1984 | Monaghan . |
| 4,517,915 | 5/1985 | Olsson et al. . |
| 4,744,810 | 5/1988 | Battigelli et al. . |
| 5,005,511 | 4/1991 | Olsson . |
| 5,051,123 | 9/1991 | Nurmi . |
| 5,109,948 | 5/1992 | Sandstrom . |
| 5,268,015 | 12/1993 | Furtak et al. . |

FOREIGN PATENT DOCUMENTS

| | | |
|---|---|---|
| 709612 | 5/1954 | European Pat. Off. . |
| 930543 | 7/1963 | European Pat. Off. . |
| 699172 | 12/1965 | Italy . |

*Primary Examiner*—John Hoffmann

*Attorney, Agent, or Firm*—C. Michael Gegenheimer; Curtis B. Brueske

[57] ABSTRACT

Methods, apparatuses, and devices are disclosed for collecting a veil including long fibers with high speed conveyor surfaces to produce a web of loosely related fibers, and further forming a wool pack by distributing the web of fibers with low frequency sound. The methods, apparatuses, and devices are particularly useful in collecting long fibers, and producing wool packs including long glass fibers.

10 Claims, 2 Drawing Sheets

WOOL PACK FORMING APPARATUS USING HIGH SPEED ROTATING DRUMS AND LOW FREQUENCY SOUND DISTRIBUTION

This is a division of application Ser. No. 08/236,067 filed May 2, 1994.

TECHNICAL FIELD

This invention relates to wool materials of mineral fibers and, more specifically, to insulation products of long glass fibers. The invention also pertains to the manufacture of insulation products made of long wool fibers.

BACKGROUND OF THE INVENTION

Small diameter glass fibers are useful in a variety of applications including acoustical or thermal insulation materials. When these small diameter glass fibers are properly assembled into a lattice or web, commonly called a wool pack, glass fibers which individually lack strength or stiffness can be formed into a product which is quite strong. The glass fiber insulation which is produced is lightweight, highly compressible and resilient. For purposes of this patent specification, in using the terms "glass fibers" and "glass compositions", "glass" is intended to include many of the glassy mineral materials, such as rock, slag and basalt, as well as traditional glasses.

The common prior art methods for producing glass fiber insulation products involve producing glass fibers from a rotary process. A single molten glass composition is forced through the orifices in the outer wall of a centrifuge or spinner, producing primarily straight glass fibers. The fibers are drawn downward by a blower, and conventional air knife and lapping techniques are typically used to disperse the veil. The binder required to bond the fibers into a wool product is sprayed onto the fibers as they are drawn downward. The fibers are then collected and formed into a wool pack. The wool pack is further processed into insulation products by heating in an oven, and mechanically shaping and cutting the wool pack.

Ideally, insulation products of glass fibers would have uniform spacing between fibers assembled in the lattice. Glass fiber insulation is basically a lattice which traps air between the fibers and prevents circulation of air to inhibit heat transfer. As well, the lattice also retards heat transfer by scattering thermal radiation. A more uniform spacing of fibers would maximize scattering and, therefore, have greater insulating capability.

In the production of wool insulating materials of glass fibers, it becomes necessary to use fibers that are relatively short to achieve desirable lattice properties. Known lapping techniques for dispersion of short fibers in a veil have provided acceptable, although not ideal fiber distribution. By contrast, long fibers tend to become entangled with each other, forming ropes or strings. For purposes of this patent specification, in using the terms "short fibers" and "long fibers" the term "short fibers" is intended to include fibers of approximately 2.54 centimeters (approximately 1 inch) and less, and "long fibers" are intended to include fibers longer than approximately 5.08 centimeters (approximately 2 inches).

Long fibers are more prone to entangle than short fibers, due, in part to their different aerodynamic properties, in addition to fiberizer throughput and geometry. Conventional lapping techniques have failed to eliminate, and rather tend to enhance, formation of ropes and strings in veils of long or semi-continuous fibers. Even when undisturbed, veils of long fibers tend to form ropes and strings as the veil slows in its descent to the collection surface. Despite movement of the collection surface, long glass fibers (as do undisturbed veils of short fibers) tend to pile up into nonuniform packs of fibers, and unmanageable fiber accumulations. These nonuniform packs, characterized in part by roping and string formation, have long prevented significant commercial use of long fibers. The ropes of long fibers produce a commercially undesirable appearance and, more importantly, create deviation from the ideal uniform lattice and reduce the insulating abilities of the glass wool.

However, even short fibers that are straight form only a haphazard lattice, and some of the fibers lie bunched together. As a result, existing glass wool insulating materials continue to have significant non-uniformities in the distribution of fibers within the product. Thus, the ideal uniform lattice structure cannot be achieved.

A further problem presented by use of short straight fibers is the binder material necessarily added to the fibers to provide product integrity. Binder provides bonding at the fiber to fiber intersections in the lattice, but is expensive and has several environmental drawbacks. As most binders include organic compounds, great pains must be taken to process effluent from the production process to ameliorate the negative environmental impact of such compounds. Further, the binder must be cured with an oven, using additional energy and creating additional environmental cleanup costs. While long fibers display fiber to fiber entanglement even without binder, the nonuniformity of the resulting wool packs has long made them commercially undesirable.

Finally, in addition to the properties of uniformity and integrity, it is desirable for wool packs to exhibit recovery from compression. In the shipping and packaging of insulation products, high compressibility is preferred. It is desirable to compress the wool for shipping and then have it recover rapidly and reliably to the desired size. When the product is compressed, the binder holds firm at fiber to fiber intersections while the glass fibers themselves flex. If the stress upon the fiber increases due to excessive compression, the fiber breaks. Thus, current insulation products are limited in the amount of compression possible while still attaining adequate recovery.

Nonetheless, because long fibers are problematic in nearly all respects, commercial wool insulation products of glass fibers have long used only short straight fibers, despite the various drawbacks of short fibers in lattice non-uniformity, need for binder and related environmental concerns, and limited compressibility. Accordingly, the need remains for further improvements in wool insulation products to improve wool pack properties, reduce cost and eliminate environmental concerns.

SUMMARY OF THE INVENTION

The present invention satisfies that need by providing a method, apparatus and device for forming wool packs of long glass fibers which provide substantial lattice uniformity, eliminate the need for binder, and result in a wool pack which displays significant compressibility and recovery desired for commercial products.

In accordance with the present invention a method and apparatus for forming a wool pack of glass fibers from a veil of fibers produced from a fiberizing apparatus is provided. The apparatus includes at least two high speed foraminous conveyor surfaces in spaced relationship, defining a gap therebetween, moving in generally downward directions, and positioned to receive the veil. A suction apparatus is positioned to exhaust gases from the veil through at least one of the high speed foraminous conveyor surfaces, and the veil is conveyed through the gap to form a web of loosely related glass fibers traveling in a generally downward direction defining an initial path of travel. The apparatus further includes a lapping device as described above for lateral movement of a web, and a receiving surface.

In one of the broadest aspects of the invention the low frequency sound is used to distribute a flow of fibers which can be of any type, either mineral fibers, polymer fibers or other types of fibers. The invention can also be used on a combined stream of two or more types of fibers, such as glass fibers and polymer fibers.

The conveyor surfaces of the apparatus are operable at high speeds, preferably approximately equal to the rate at which the veil travels in a generally downward direction, or more generally within the range of 25% to 200% of the rate of veil travel as measured at the conveyor surfaces, and most preferably about 100%. In this regard, the high speed conveyor surfaces configured in accordance with the present invention make possible the collection of long fibers, not previously attained in the prior art. For purposes of this invention, the measurement of the speed of the veil is made at the point which is the same distance below the fiberizer as is the gap between the two conveyor surfaces, but with the conveyor surfaces removed. For example, if the gap is one meter beneath the fiberizer, then the speed of the veil is to be measured at a point one meter beneath the fiberizer, but without the influence of the conveyor surfaces. Typically, the fibers are traveling at a speed within the range of from about 3 to about 100 meters/second, and most likely within the range of from about 5 to about 30 meters/second.

The term "web" is used to describe the stream of loosely related fibers which is produced when the air is removed from the veil in accordance with the present invention. It is understood that a small portion of the air traveling with the veil will pass through the gap and remain with the web.

As used herein, the phrase "wool pack of long fibers" refers to wool packs having a substantial proportion of long fibers, generally 50% or more by number or weight, but may also include wool packs having somewhat smaller percentages (greater than approximately 10%) of long fibers which, nonetheless, demonstrate the behavior of wool packs having higher percentages of long fibers.

Regardless of the terminology, a significant feature of the present invention is present in the use of high speed conveyor surfaces (e.g. drums) and their ability to separate fibers from gases in the veil without building up a fiber structure of significance. Rather, the resulting web exhibits an open structure desirable for wool pack production. Where the high speed conveyor surfaces are applied to produce webs of short fibers, a structure amenable to application of binder to the web of short fibers is provided. The open nature of the web permits better penetration of the binder into the web. Application of binder to a short fiber web is desirable to reduce the environmental impact of the binder compared to conventional techniques which apply binder during fiberizing. The lower temperature of the web reduces the production of volatile organics which must be treated, and since binder is applied to an "airless veil" the overall air volume which will include organic binder compounds requiring treatment is greatly reduced.

Further, in accordance with the present invention, a method is disclosed for forming a wool pack of fibers. The method begins with providing a generally continuous web of at least loosely related fibers traveling in a generally downward direction. In the preferred embodiment, this is a web produced by the apparatus and method discussed above. The method next includes applying low frequency sound to the web to cause it to repeatedly deviate in its downward travel, followed by collection of the web as it deviates in its travel. The low frequency sound may also be referred to herein as infrasound, as the useful ranges of low frequency sound fall generally within and near the range associated with infrasound.

Unlike prior art lapping techniques, it is believed that the present invention tends to induce motion of the fibers of the web in a field. Due to the width and openness of the web, a generally uniform velocity field is established across the web, and the fibers therein tend to remain undisturbed as the web moves. Moreover, use of low frequency sound makes higher frequency lapping possible than has been achieved with conventional methods, including mechanical devices and air knives. Movement of the veil in accordance with the present invention permits improved distribution of the web for various forms of collection.

Accordingly, the present invention further includes a lapping device which causes lapping of a generally continuous web of at least loosely related fibers. In its simplest embodiment, the lapping device of the present invention includes one low frequency sound generator having one resonator tube which has an open end from which sound may be emitted. The resonator tube is shaped for emission of low frequency sound to a portion of a web. Preferably, the lapping device has two resonator tubes with the open ends thereof in spaced, opposing relationship, on opposite sides of the downward path of travel of a web. Thus, in the preferred method, the low frequency sound is applied at generally opposing locations near the web, causing portions of the web to deviate in generally alternate lateral directions in its direction of travel.

The apparatus and lapping device of the present invention are compact, making it possible to reduce the distance from the rotary fiberizing apparatus to the collecting surface. The high speed conveyor surfaces which receive the veil may also be positioned closer to the rotary fiberizing apparatus, reducing the volume of gases which must be removed in collecting the fibers, and reducing the size of gas handling devices and related environmental costs. As well, the formation of a wool pack with related entanglement in accordance with the present invention, particularly with regard to long fibers, permits the elimination of binder along with its related environmental costs.

DETAILED DESCRIPTION OF THE PREFERRED EMBODIMENTS

Figure 1:
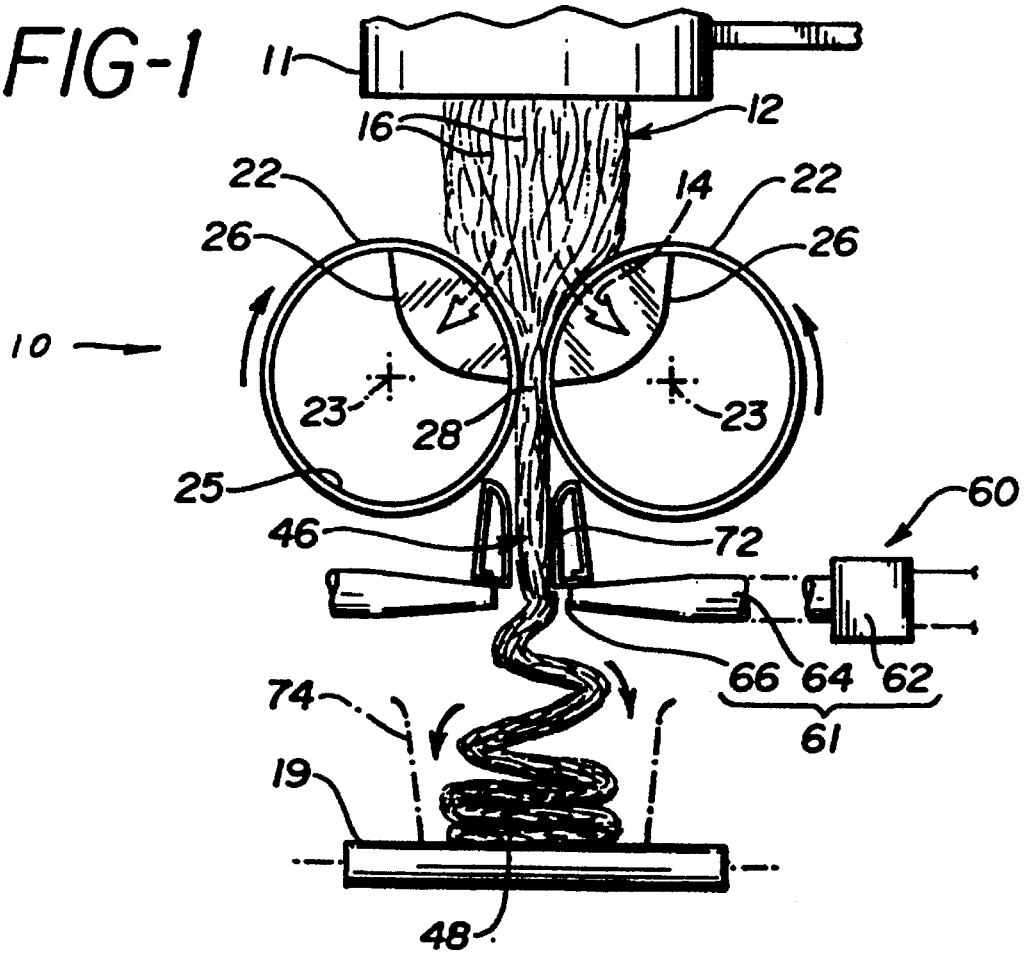
FIG. 1 is a schematic view in elevation of the present invention.
Figure 2:
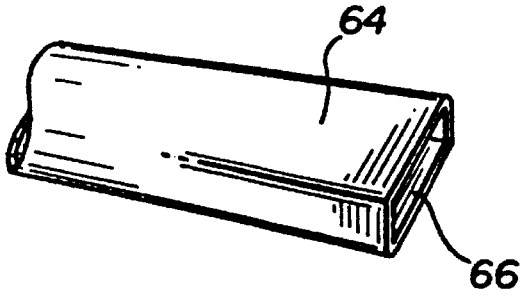
FIG. 2 is a schematic detail view in perspective of the preferred embodiment of the end of a resonator tube.
Figure 3:
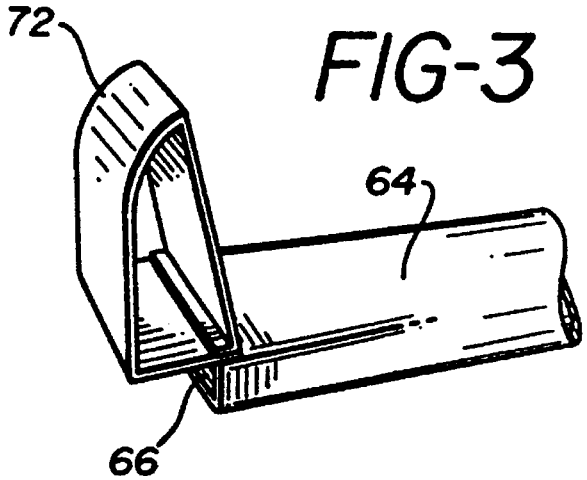
FIG. 3 is a schematic detail view in perspective of a shield placed at the end of a resonator tube.

The method and apparatus 10 of the present invention may be used to produce wool packs 48 of long glass fibers 16 as representatively shown in FIGS. 1 through 3.

Referring to FIG. 1, the present invention provides an apparatus 10 for forming a wool pack 48 from fibers 16 produced from a fiberizing apparatus 11. The apparatus 10 may be provided in several configurations. Regardless, however, the apparatus 10 includes at least two high speed foraminous conveyor surfaces 22 in spaced relationship, defining a gap 28 therebetween to receive a veil 12 from a fiberizing apparatus. A suction apparatus 26 is positioned to exhaust gases 14 from the veil 12 through at least one of the foraminous conveyor surfaces 22, and the veil 12 received on the surfaces 22 is conveyed through the gap 28 to form a web 46 of loosely related glass fibers 16 traveling in a generally downward direction defining an initial path of travel. The suction apparatus 26 is constructed in a conventional manner with a suction plenum distributing suction to approximately a quarter of the conveyor surface 22, from approximately the 12 to 3 o'clock position for the left conveyor surface 22 (or 9 o'clock to 12 o'clock position for the right conveyor surface 22), as shown in FIG. 1. The suction plenum is connected to a source of vacuum (not shown).

The apparatus 10 just described includes foraminous conveyor surfaces 22 which are high speed surfaces 22 moving in generally downward directions, positioned to receive a veil 12. This configuration is particularly useful in collecting long fibers 16 produced by a rotary fiberizing apparatus 11. This embodiment of the apparatus 10 preferably further includes a lapping device for lateral movement of a web 46, and may include the lapping device 60 of the present invention described below, or alternately, other conventional lapping devices and techniques, downstream from the high speed conveyor surfaces 22. The apparatus may further include a collection surface 19 for collecting the web 46 as portions thereof deviate in their travel.

The high speed conveyor surfaces 22 of the apparatus 10 are preferably operable at speeds approximately equal to the rate at which the veil 12 received thereon travels in a generally downward direction as measured at the conveyor surfaces. However, the high speed conveyor surfaces 22 may be operated at approximately 25% to approximately 200%, or more narrowly, 50% to 175% of the veil rate. The high speed conveyor surfaces 22 are preferably positioned approximately 20 centimeters to approximately 1.5 meters from the spinner of a rotary fiberizing apparatus.

It has been found that conveyor surfaces 22 operated at high speeds and configured as taught in accordance with the present invention make possible the collection of long fibers 16 which has not been previously attained in the prior art. While there is significant entanglement with long fibers, the fibers in the web 46 are generally randomly oriented and loosely related. Where short fibers are used, the entanglement is much reduced and the relation between fibers is even more tenuous.

As shown in FIG. 1, it is further preferred to include shields 72 in the apparatus of the present invention which define a passage through which the web 46 freely passes, i.e. passes without significant surface contact. The shields 72 are preferably positioned in spaced opposing relationship so that their surfaces define the passage. They may be mounted on the ends of the resonator tubes 24 as shown in FIGS. 1 and 3, or in any other suitable manner. The shields 72 serve to stabilize the travel of the web 46 by shielding it from air currents established by conveyor surfaces 22, such as high speed rotating drums 25, and from ambient air turbulence. Stability in the downward web travel is improved, and web wander substantially eliminated.

Optionally, the present invention may further include a binder spraying device downstream from the high speed conveyor surfaces 22, positioned either between the shields 72 and the resonator tubes 64, with the resonator tubes 64 spaced downward from the shields (not shown), or below the resonator tubes 64. The high speed conveyor surfaces 22 advantageously produce a web of loosely related fibers having an open structure. The open structure allows penetration of binder applied to at least one face of the web 46, particularly a web of short fibers, after it exits from the surfaces 22. Application of binder to a web reduces some of the environment drawbacks associated with the use of binder in wool production. The lower temperature of the web reduces the volatile organics which are otherwise formed by spraying binder on hot veils 12. As well, the overall air volume including binder compounds arising from collection conveyors is smaller than the volume of air generated by conventional techniques which apply binder to short fibers in veils.

The apparatus 10 may further include a lapping device 60 to provide distribution of the web 46 over a collection surface 19. Conventional mechanical devices or air knives may be used with the apparatus 10. However, due to the speed of downward travel of the web 46, the high speed conveyor surfaces 22 of the present invention are preferably coupled with the lapping device 60 of the present invention, which causes portions of the web 46 to deviate laterally by applying low frequency sound thereto, as more fully described below. The lapping device 60 of the present invention is preferred because it is capable of higher frequency lapping than conventional devices. Thus, combination of the high speed conveyor surfaces 22 and the lapping device 60 of the present invention are preferred for distribute a of a web 46 of loosely related fibers, particularly long fibers 16, on a receiving surface 19, thereby producing a wool pack 48 of long fibers 16 suitable for commercial products.

Receiving surface 19 can be a box, conveyor, chute or other device. Regardless, as shown in FIG. 1, collection guides 74 may be further provided to assist in producing a wool pack 48 from the web 46.

Low frequency sound may be applied to any web 46 as disclosed herein, whether the web 46 is comprised substantially of long or short fibers. Accordingly, the present invention further encompasses a lapping device 60 which causes lateral movement or a lapping motion in a generally continuous web 46. Still referring to FIG. 1, in its simplest embodiment, the lapping device 60 of the present invention includes one low frequency sound generator 61 having one resonator tube 64 with an open end 66 from which sound may be emitted, and a feeder 62. The tube 64 has a length of $\lambda/4$, where $\lambda$ is the wavelength of the low frequency sound. The $\lambda/4$ length produces a standing wave in the tube 64, which results in a high pressure low air velocity node at the feeder end of the tube 64, and a low pressure, high air velocity node at the open end 66. The resonator tube 64 is also shaped for emission of low frequency sound to a portion of a web 46, preferably as shown in FIG. 2, where the tubular shape gradually and smoothly transitions to a rectangular shape at the open end 66 which provides for more desirable sound distribution.

The feeder 62 establishes the frequency of the sound produced. Feeders 62 typically use pressurized air and/or mechanical components to produce low frequency sound, as shown in U.S. Pat. Nos. 4,517,915, issued May 21, 1985 to Olsson et al., 5,005,511, issued Apr. 9, 1991 to Olsson et al., and 5,109,948, issued May 5, 1992 to Sandstrom. Low frequency sound generators are commercially available from Infrasonik AB, Stockholm, Sweden, the assignee of the patents noted, and may be used to produce low frequency sound in one or two resonator tubes 64. Connection to power and pressurized air lines is also provided where needed, as shown in FIG. 1.

Figure 4:
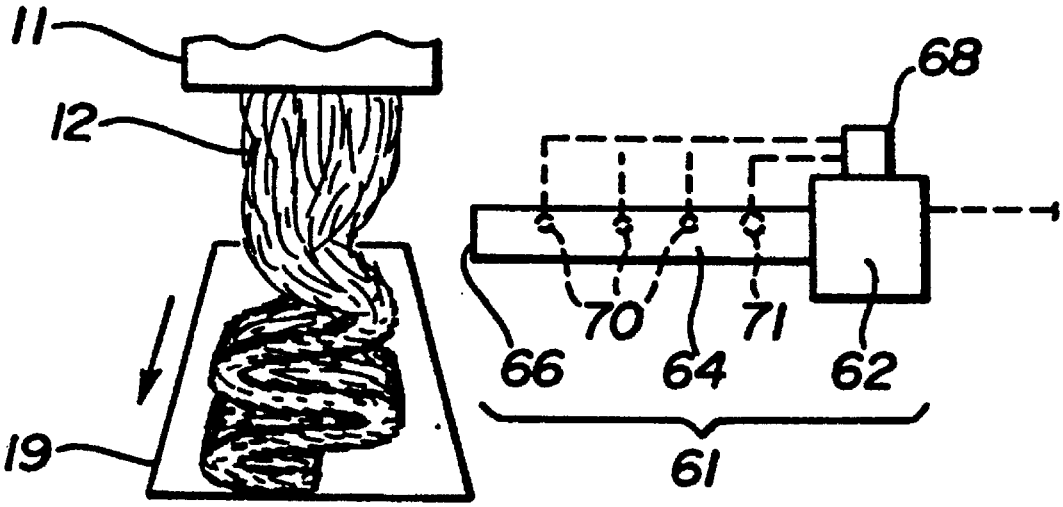
FIG. 4 is a block diagram showing a frequency control device in accordance with the present invention.

Further, referring now to FIG. 4, in accordance with the present invention, the low frequency sound generator 61 may include a frequency variation device 68 to vary the frequency of sound produced therewith. This is desirable where the temperature of the environment surrounding and affecting the low frequency sound generator 61 is variable. As noted in U.S. Pat. No. 4,517,915, the sound frequency and wavelength are interrelated according to $$f=C/\lambda$$

where f=the sound frequency c=the propagation rate of the sound wave, and

λ=the wavelength.

The resonator tube lengths are typically fixed, as is their diameter, and the appropriate length of the tube 64 to produce the low frequency sound is dependent on wavelength. Thus, as the air temperature changes, it is desirable to provide for frequency variation to produce the desired wavelength.

Accordingly, as further shown in FIG. 4, in a further feature of the present invention, the low frequency sound generator 61 includes a frequency variation device 68, such as an electrical controller or a mechanically adjusting element or an element to vary the inlet of air pressure to the feeder 62, as well as a sensor to provide feedback to the frequency variation device. The sensor may be an air temperature sensor 70 or an array of temperature sensors 70 located in the resonator tubes 64, or a pressure sensor 71 preferably located at the feeder end of the tube 64. The temperature in the tube 64 may vary over its length, and the signals from an array of temperature sensors may be averaged, or given a weighted average. The sensors 70 and 71 can be used separately or in combination to provide a signal to the frequency variation device 68 to variably control the frequency of sound produced by the low frequency sound generator 61. The frequency variation device 68 and sensors 70, 71 allow the generator 61 to adjust to the effects of temperature changes in the operating environment and maintain operation at the resonant frequency of the resonator tubes 64.

Referring again to FIG. 1, preferably, two resonator tubes 64 are provided with their open ends 66 in spaced, opposing relationship, on opposite sides of the downward path of travel of a web 46. It is preferred to apply the low frequency sound at generally opposing locations near the web 46 to cause portions of the web 46 to deviate in generally alternate lateral directions in its direction of travel. The shields 72 which promote web stability also enhance the effectiveness of the low frequency sound generator 61.

Thus, in summary, it may be seen in accordance with one aspect of the present invention that the method for forming a wool pack begins with providing a generally continuous web 46 traveling in a generally downward direction, and includes applying low frequency sound to the web 46 to cause portions of the web to deviate in their downward travel, followed by collecting the web 46 as it deviates in its travel. The useful ranges of low frequency sound fall generally below 30 cycles per second. The frequency varies depending on other variables such as the speed of the web, length of the fibers, and ambient temperature. Thus, the frequency actually used in a particular application may vary, and require determination by trial and error.

In its preferred embodiment the method is particularly useful with long fibers 16, and includes receiving a veil 12 of moving gases 14 and glass fibers 16 traveling in a generally downward direction from a rotary fiberizing apparatus 11. The method continues by separating gases 14 from the veil 12, forming a web 46 of the fibers 16, and advancing the web 46 in a generally downward direction. These steps are preferably performed using high speed conveyor surfaces 22, such as foraminous drums 25, although other foraminous conveyor surfaces, such as chain surfaces, known in the art may be also be used. Thereafter, low frequency sound is applied to cause the web 46 to deviate in its travel.

EXAMPLE

Although no attempt is made to limit the present invention thereto, an illustrative embodiment of the present invention includes a pair of rotating drums 25 having diameters of approximately 0.61 meters (24 inches), foraminous conveyor surfaces 22, approximately 60% open, and spaced apart to define a gap 28 of approximately 1.25 centimeters (0.5 inches) at their point of closest approach. Their axes 23 are approximately 0.91 meters (3 feet) from the bottom of the spinner of a rotary fiberizing apparatus 11, which produces a veil 12 traveling at approximately 10 meters per second. The veil speed will vary with the distance from the spinner. No binder is applied to the fibers 16.

The drums 25 rotate with a surface speed approximately equal to the veil speed, adjustable to plus or minus approximately 50% of the veil speed. The axes 23 of the drums are approximately 1.37 meters (4.5 feet) above the receiving surface 19. The resonator tubes 64 are approximately 0.15 meters (6 inches) in diameter and have a transition piece extending from the circular cross section a distance of approximately 0.53 meters (21 inches), gradually and smoothly, to the open end 66 which is rectangular in shape, approximately 0.56 meters (22 inches) wide by 0.04 meters (1.5 inches) high. The centerlines of the resonator tubes 64 at their open ends 66 are approximately 0.46 meters (18 inches) below the axes 23 of the drums, and are separated about 0.20 meters (8 inches). The low frequency sound generator 61 operates at approximately 20 cycles per second. The shields 72 are spaced apart approximately 0.076 to 0.10 meters (3 to 4 inches), and frictional contact between the shields and the moving web 46 is avoided. The shields 72 are approximately as wide as the web 46, and extend upward towards the drums 25, tapering as shown in FIG. 3, as they approach the drums. In operation, the low frequency sound generator 61 produced laps of approximately 0.51 meters (20 inches) to each side of the centerline of the space between the open ends 66 of the resonator tubes.

The conveyor surfaces 22 may be spaced apart to define gaps 28 of various widths, preferably between approximately 0.64 centimeters (cm) (approximately 0.25 inches) and approximately 5.08 centimeters (cm) (approximately 2 inches), although a broader range of possible gaps 28 is possible so long as the desired result is achieved. The distance between the open ends 66 of the resonator tubes 64 may vary depending on the gap 28 defined. Other distances (i.e. from the gap 28 to open ends 66 of the resonator tubes, and from the open ends 66 to surface 19) may vary as well, depending on the speed of the conveyor surfaces 22.

The illustrative example was used in accordance with the present invention to form a web of long fibers produced by a rotary fiberizing apparatus 11. The long fibers 16 were further lapped with the lapping device 60 of the present invention. The long fibers 16 were made in accordance with co-pending and commonly assigned U.S. patent application Ser. No. 08/148,098, filed Nov. 5, 1993, entitled DUAL-GLASS FIBERS AND INSULATION PRODUCTS THEREFROM, by Houpt et al, which is incorporated herein by reference, and which is preferred in practicing the present invention. A bi-component fiberizing apparatus includes molten glass feeding elements for two separate glass types, which are combined in producing fibers in the rotary fiberizing apparatus 11, as taught by Houpt et al.

There is no intent to limit the present invention to the illustrative and preferred embodiments described in detail herein. Rather, the present invention may be practiced to collect and/or lap short or long fibers, straight or not, produced by conventional fiberizing techniques, whether the fibers are made of glass, other known fiber materials, or combinations thereof. Moreover, the lapping device 60 of the present invention may also be used to move webs of loosely related fibers whether the fibers in the web are initially produced in a veil or provided by other production techniques. However, the present invention is particularly suited to provide collection and/or lapping of veils 12 of long fibers, collection and lapping of which has long been problematic in the art.

While certain representative embodiments and details have been shown for purposes of illustrating the invention, it will be apparent to those skilled in the art that various changes in the method and system disclosed herein may be made without departing from the scope of the invention, which is defined in the appended claims.

We claim:

1. An apparatus for forming a fibrous wool pack from a veil of fibers produced from a fiberizing apparatus, the apparatus comprising:

two foraminous conveyor surfaces for receiving the veil, the conveyor surfaces being in a spaced relationship and defining a gap therebetween, the conveyor surfaces being mounted for movement in a generally downward direction;

a suction apparatus positioned to exhaust gases from the veil through at least one of the conveyor surfaces, whereby the fibers in the veil are conveyed through the gap to form a web of fibers traveling in a generally downward direction;

a lapping device for lateral movement of the web, the lapping device comprising a generator including a resonator robe having an open end from which sound may be emitted, wherein the resonator robe is shaped for emission of sound at a frequency less than about 30 cycles per second to a portion of a web; and a receiving surface for receiving the web to form a fibrous wool pack.

2. The apparatus of claim 1 wherein the two conveyor surfaces comprise generally convex surfaces.

3. The apparatus of claim 1 including a fiberizing apparatus for producing the veil of fibers, and further wherein the gap is positioned at a distance within the range of from approximately 20 centimeters to approximately 1.5 meters beneath the fiberizing apparatus.

4. The apparatus of claim 1 further comprising a pair of opposing shields positioned between the conveyor surfaces and the lapping device.

5. The apparatus of claim 1 further comprising a binder spraying station positioned below the conveyor surfaces and directed to apply binder to at least one face of the web.

6. An apparatus for forming a wool pack comprising:

a rotary, fiberizing apparatus for producing a veil of glass fibers;

two foraminous conveyor surfaces for receiving the veil, the conveyor surfaces being in a spaced relationship and defining a gap therebetween, the conveyor surfaces being mounted for movement in a generally downward direction;

a suction apparatus positioned to exhaust gases from the fibers through at least one of the conveyor surfaces, whereby the fibers are conveyed through the gap to form a web of fibers traveling in a generally downward direction;

a lapping device for lateral movement of the web, the lapping device comprising at least one sound generator for generating sound at a frequency less than about 30 cycles per second, and the lapping device including a resonator tube having an open end from which sound may be emitted, wherein the sound generator is shaped for emission of sound to a portion of a web; and a receiving surface for receiving the web to form a fibrous wool pack.

7. The apparatus of claim 6 wherein the gap is positioned at a distance within the range of from approximately 20 centimeters to approximately 1.5 meters beneath the fiberizing apparatus.

8. The apparatus of claim 6 further comprising a pair of opposing shields positioned between the conveyor surfaces and the lapping device.

9. An apparatus for forming a wool pack comprising:

A rotary, fiberizing apparatus for producing a veil of glass fibers;

two foraminous conveyor surfaces for receiving the veil, the conveyor surfaces being in a spaced relationship and defining a gap therebetween, the conveyor surfaces being mounted for movement in a generally downward direction, and the gap being positioned at a distance within the range of from approximately 20 centimeters to approximately 1.5 meters beneath the fiberizing apparatus;

a suction apparatus positioned to exhaust gases from the fibers through at least one of the conveyor surfaces, whereby the fibers are conveyed through the gap to form a web of fibers traveling in a generally downward direction;

a pair of opposing shields positioned between the conveyor surfaces and the lapping device;

a lapping device for lateral movement of the web, the lapping device comprising at least one sound generator including a resonator tube having an open end from which sound may be emitted, wherein the resonator tube is shaped for emission of sound at a frequency less than about 30 cycles per second to a portion of a web; and a receiving surface for receiving the web to form a fibrous wool pack.

10. The apparatus of claim 9 further comprising a binder spraying station positioned below the conveyor surfaces and directed to apply binder to at least one face of the web.

* * * * *

UNITED STATES PATENT AND TRADEMARK OFFICE

CERTIFICATE OF CORRECTION

PATENT NO. : 5,620,497

DATED : April 15, 1997

INVENTOR(S) : David P. Aschenbeck et al.

It is certified that error appears in the above-indentified patent and that said Letters Patent is hereby corrected as shown below:

In Claim 1, Line 16, "robe" should be - -tube - -; and

In Claim 1, Line 17, "robe" should be - - tube - -.

Signed and Sealed this

Twenty-ninth Day of July, 1997

Bruce Lehman

*Attest:*

BRUCE LEHMAN

*Attesting Officer*

*Commissioner of Patents and Trademarks*